US006431384B1

(12) United States Patent
Dubach

(10) Patent No.: US 6,431,384 B1
(45) Date of Patent: Aug. 13, 2002

(54) CLOSING DEVICE

(75) Inventor: Werner Fritz Dubach, Maur (CH)

(73) Assignee: Terxo AG, Wetzikon-Kempten (CH)

( * ) Notice: Subject to any disclaimer, the term of this patent is extended or adjusted under 35 U.S.C. 154(b) by 0 days.

(21) Appl. No.: 09/530,002

(22) PCT Filed: Oct. 21, 1998

(86) PCT No.: PCT/CH98/00445

§ 371 (c)(1),
(2), (4) Date: Apr. 21, 2000

(87) PCT Pub. No.: WO99/21767

PCT Pub. Date: May 6, 1999

(30) Foreign Application Priority Data

Oct. 23, 1997 (CH) ..... 2479/97

(51) Int. Cl.[7] ..... B65D 17/30; B65D 43/16; B65D 43/24; B65D 51/22

(52) U.S. Cl. ..... 220/258; 220/259; 220/267; 220/277; 220/832; 220/838; 229/204; 229/125.08

(58) Field of Search ..... 220/258, 259, 220/265, 266, 267, 268, 277, 810, 825, 831, 836, 837, 838, 832; 229/204, 125.03, 125.08, 125.14, 125.04

(56) References Cited

U.S. PATENT DOCUMENTS

| | | | | | |
|---|---|---|---|---|---|
| 4,615,462 | A | * | 10/1986 | Sacherer et al. | 220/847 |
| 5,101,999 | A | * | 4/1992 | Robichaud et al. | 220/258 |
| 5,639,018 | A | * | 6/1997 | Tokarski et al. | 229/125.04 |
| 5,823,420 | A | * | 10/1998 | Tokarski et al. | 229/125.04 |
| 5,875,959 | A | * | 3/1999 | Weiteder et al. | 229/125.15 |
| 5,992,734 | A | * | 11/1999 | Tokarski et al. | 229/125.15 |

* cited by examiner

*Primary Examiner*—Lee Young
*Assistant Examiner*—Niki M. Eloshway
(74) *Attorney, Agent, or Firm*—Pauley Petersen Kinne & Erickson

(57) ABSTRACT

A closing device located on a container of laminated paper, over a predetermined opening. The device has a lower part with a pouring opening and a cover closing the opening. A push-piece for breaking open the predetermined opening is provided in the lower part. The push-piece is joined to the lower part by a snap hinge, making the device more user-friendly and ensuring that the laminated paper predetermined opening does not obstruct the pouring opening area.

8 Claims, 2 Drawing Sheets

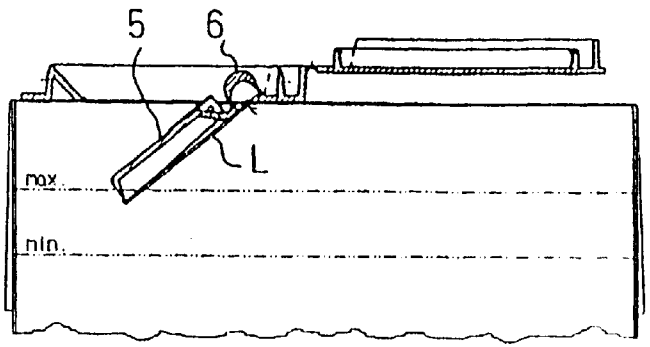
FIG. 3
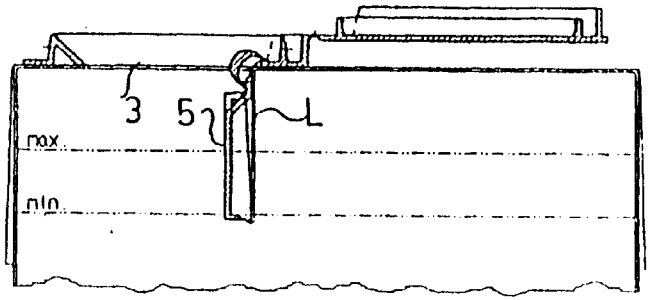
FIG. 4
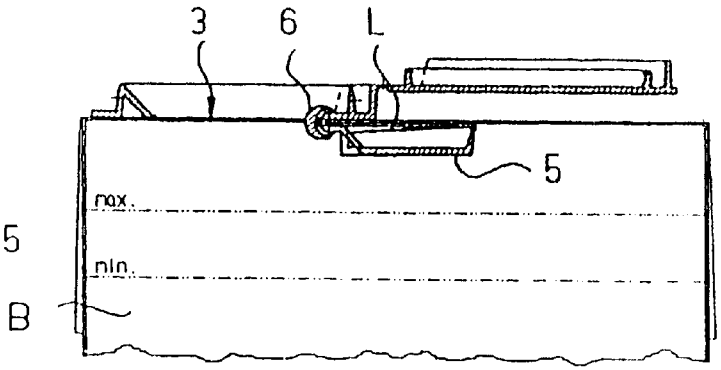
FIG. 5
FIG. 1
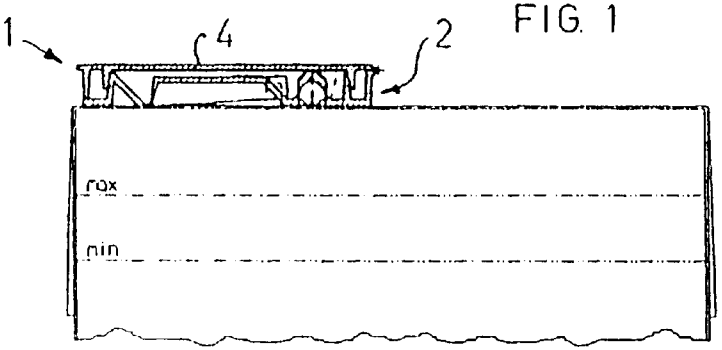
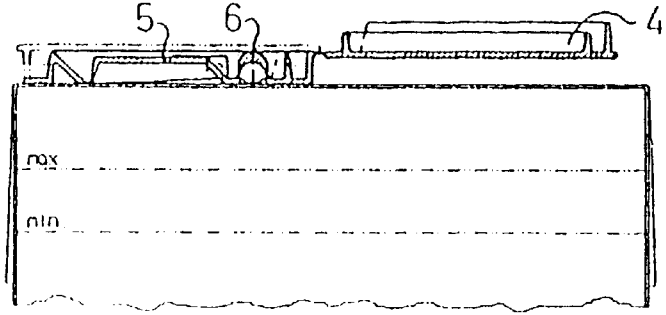
FIG. 2
FIG. 6
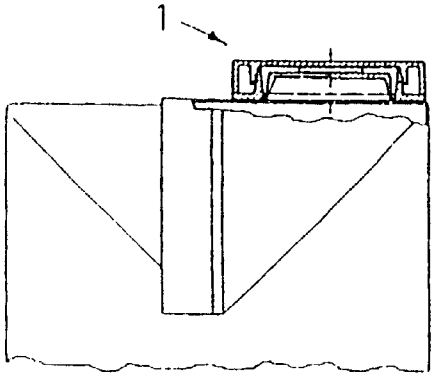

CLOSING DEVICE

BACKGROUND OF THE INVENTION

1. Field of the Invention

This invention relates to a closure device for laminated paper containers, with the closure device arranged on the container over an opening of the container.

2. Description of Prior Art

Conventional containers of laminated paper have a cubic basic shape and are for packaging liquid products, in particular products of the food industry. The construction of the laminated papers used from the outside to the inside have the following layer sequence: polyethylene film; cardboard; polyethylene; aluminum layer; and polyethylene.

In this multi-layered material which is usually called laminated paper, with containers having a closure device, in the surface of the container in the laminated paper there is a predetermined opening. With the predetermined opening, a pre-cut opening normally has the upper three layers cut through, with the lower two layers of aluminum and polyethylene completely intact.

The closure devices are for containers of laminated paper which are known in two basic types. With an older type the container is already opened and the opening is sealed with a seal which can be pulled back. After removal of the seal the container is sealingly closed by the closure device attached onto the container. Accordingly, such closure device has a lower part with a pouring-out opening and a cover pivotally mounted thereon which closes the pouring-out opening with a sealed wall that sealingly engages into the pouring-out opening.

The seal is destroyed either by tearing open or by perforating or cutting, using a device which is arranged on the cover. This variation however requires the cover in a completely opened condition to be transported, stored and handled, by which there exists the danger of an undesired destruction of the seal.

Thus closure devices of a second type have been developed wherein the container of laminated paper is unopened and comprises only a predetermined opening. Such a predetermined opening may be of various types. Mostly several layers of the laminate are cut through and only the inner plastic layer and the aluminium layer lying thereover are still intact, as previously described.

The predetermined opening may have various forms, specifically one which is longitudinally separable and forms two tabs which may be laterally folded away from or of a single U-shaped tab which may be folded away to the rear.

Such predetermined openings must thus be pierced and cut open. For this purpose, for example, U.S. Pat. No. 4,934,590 shows a conventional closure device.

The closure device described here has, present in the lower part, a pivotal push-piece which serves for completely cutting open the predetermined opening and thereafter moving the corresponding U-shaped tab out of the pouring-out region to the rear. However, in the original position the push-piece which is to cut open the predetermined opening lies exposed and thus is completely unprotected against undesired or wanton destruction. The actual cover is simultaneously used as an actuation lever which in the original position is completely opened. At the same time, the surface of the cover coming to position into the container to the inside before closure for the first time is always exposed to contamination. For the mentioned reasons, such conventional closure device has not succeeded in the market.

The problem of keeping the tab from the region of the pouring-out opening has not been solved with known closure devices. The push-piece which is specifically positively and pivotally connected to the cover with this embodiment is then actually only pressed to the rear when the cover is closed. In this position, when the cover is completely opened the push-piece is completely freely pivotal and is moved forwards by the tab, because of the material elasticity, as when the container is relatively full, gets into the flow of the exiting contents by which means the pouring-out jet is interrupted.

SUMMARY OF THE INVENTION

One object of this invention is to provide a closure device of the mentioned type but without the known problem.

BRIEF DESCRIPTION OF THE DRAWINGS

The drawings show a preferred embodiment of this invention, wherein FIG. 1 shows and the subsequent FIGS. 2–7 vertical sections show the closure device attached on a suitable container of laminated paper, in various positions of use, wherein:

FIG. 1 shows a condition before the first use with a closed cover;

FIG. 2 shows the same condition shown in FIG. 1 but with an opened cover;

FIG. 3 shows a push-piece pushed in about up to an unstable equilibrium position;

FIG. 4 shows a lowest position of the push-piece;

FIG. 5 shows a permanent position of the push-piece after the first opening of the closure device;

FIG. 6 shows a section taken through the closure device in a position according to FIG. 1 but perpendicular to a longitudinal alignment;

DESCRIPTION OF PREFERRED EMBODIMENTS

Figure 7:
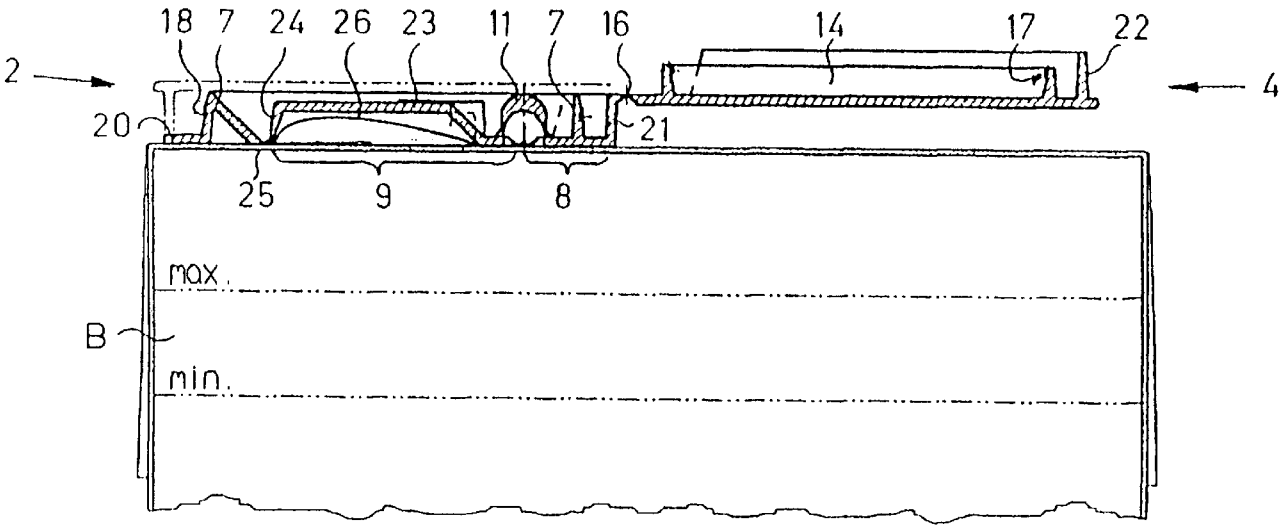
FIG. 7 shows the closure device according to FIG. 2, in an enlarged scale.
Figure 9:
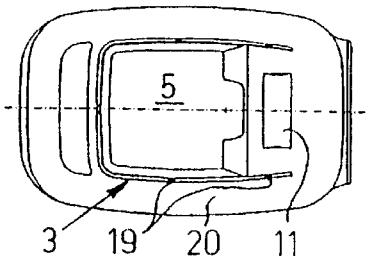
FIG. 9 shows a closed closure device in a view from below.
Figure 10:
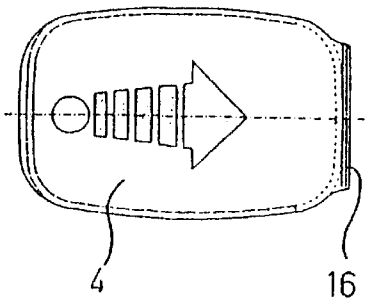
FIG. 10 shows a plan view of the closure device.
Figure 8:
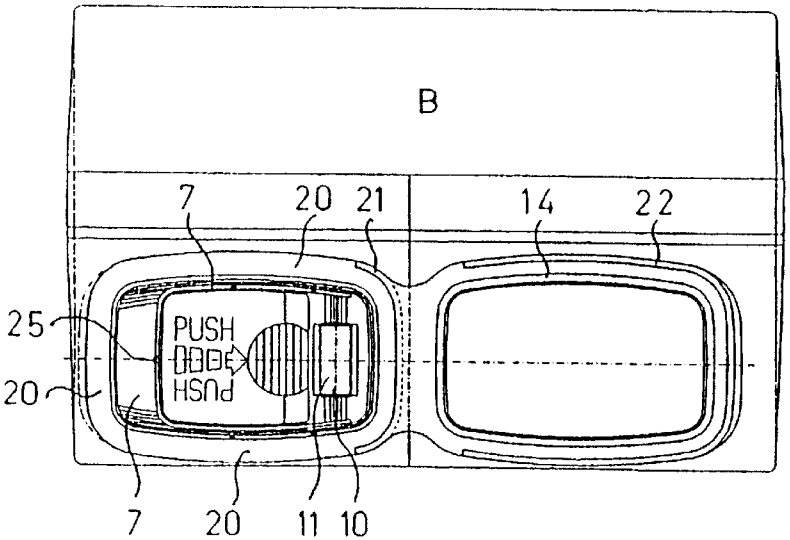
FIG. 8 shows the closure device according to FIG. 2 in a plan view, wherein the closure device is shown attached on the container.

With reference to the FIGS. 7 to 10 the closure device 1 is explained in detail. With reference to the FIGS. 1 to 6 the invention and the use of the closure device 1 is explained. Principally, the closure device 1 comprises three large-surfaced main elements, specifically a lower part 2 to which there is attached a cover 4 via a joint axis 16. The lower part 2 comprises a pouring-out opening 3 which is initially covered by a push-piece 5. The lower part 2 has a circumferential, even adhesive edge 20 with which the closure device 1 is welded or adhered onto the container of so-called laminated paper. As initially mentioned the container comprises a predetermined opening which at least approximately coincides with the pouring-out opening 3 of the closure device 1 when the closure device 1 is attached to the container B, exact to location. The push-piece 5 has two parts, specifically a large pivoting part 9 and a small fastening part 8. These two parts are connected to one another via a film hinge 10 and via a bending spring element 11. Thus the film hinge 10 is interrupted in the region of the bending spring 11. The predetermined opening in the container B must be at least as large as the pivoting part 10 of the push-piece 5. Around the pouring-out opening 3 there runs a circumferential seal wall 7 folded up with respect to the adhesive edge 20 of the lower part 2. With respect to the adhesive edge 20 of the lower part 2 the seal wall 7 is displaced concentrically inwards. In the rearwards region of the adhesive edge 20, on its periphery, there is folded up an additional wall 21 on whose upper edge there is arranged the joint axis 16 for the hinging connection of the lower part 2 to the cover 4. The cover 4 has a peripheral support wall 22 which in the closed condition of the closure device 1 is supported on the adhesive edge 20 of the lower part 2. Thus it is ensured that a pressure on the cover 4 in the closed condition before the first opening of the closure device 1 may not exert pressure on the push-piece 5 and thus effect an undesired opening of the container B. Concentrically to the support wall 22 there is attached a complete circumferential sealing ring wall 14 on the lower side of the cover 4. This is dimensioned to sealingly encompass the seal wall 7. Accordingly the seal ring wall 14 at its edge directed inwards comprises a circumferential sealing bulge 17. This acts in the closed condition of the closure device 1 in a circumferential sealing notch 18 by which means a high degree of seal may be achieved.

For supporting the push-piece 5 relative to the lower part 2 and as a guarantee element the push-piece 5 on its lower longitudinal edges is connected to the lower part 2 via predetermined breaking locations 19. This lateral arrangement is preferred because onto the predetermined breaking location 19 there does not occur a tension loading but a shear loading, by which means the predetermnined breakage location 19 may be particularly easily manufactured.

The push-piece 5 which serves for breaking open the nominal opening in the container B is thus specially formed. From a preferably centrically arranged notch element 25 which is arranged diametrically opposite the film hinge 10 of the push-piece 5, the push-piece 5 has a circumferential obliquely upwardly inclined edge 24 which finally blends into the cover surface 23 of the push-piece 5. The edge 24 from the notch element 25 with a certain taper angle in the direction towards the cover surface 23, at least in the front region of the push-piece 5 is formed as a cutting edge 26.

Proceeding from FIG. 1 from now on the closure device 1 already described in detail will be explained in its various functional positions. In the representation according to FIG. 1, the closure device 1 is in the completely closed condition. The lower part 2 of the closure device 1 is fastened on the container B. The non-viewable predetermined opening is completely closed and the container is thus sealed. The push-piece 5 is fixed to the lower part 2 layer via the predetermined breaking locations 19, and the cover 4 is closed and protects the push-piece 5 located thereunder. This situation corresponds to the transport position. With regard to plastic design as well as with other means additionally the cover 4 may be connected with respect to the lower part 2 via a guarantee element. In the simplest embodiment this may be a paper seal which at least partly overlaps the cover 4 and is connected to the container B. It is also possible at the projecting edge of the cover 4 via suitable predetermined breaking locations 19 to arrange a guarantee strip which is positively and/or non-positively connected to means, not shown, on the lower part 2 of the connection device.

The situation as is shown in FIG. 2 shows the first step of the first opening of the closure device 1 or the opening of the container B. The cover 4 is pivoted to the rear by 180°. Now the push-piece 5 is freely accessible and recognizable. This position has already been described in detail by way of FIG. 7.

By way of pressure on the push-piece 5 the container B is opened. A first intermediate position is represented in FIG. 3. With this the shaping of the push-piece 5 plays an important role. The predetermined opening in the container B may only be opened when the two still intact inner layers, specifically that of aluminum and the polyethylene layer lying innermost are first pierced and thereafter cut open. For this the push-piece 5 comprises the mentioned notch element 25 which is arranged at the end, lying opposite the film hinge 10, of the push-piece 5. With the notch element 25, the aluminum layer as well as the polyethylene layer are pierced without a force effort. Thus it is ensured that the user with a pressure on the push-piece 5 does not press this jerk-like into the inside of the container and thus contact the contents of the container, or does not spill the contents from the container to the outside. The laterally arranged predetermined breakage locations 19 additionally lead to a particularly easy opening, since the predetermined breakage locations 19, are not loaded with regard to tension but to shearing, by which means they may be easily destroyed.

Most push-pieces used today lie as a whole large surfaced themselves on the predetermined opening or have cutting edges which rest linearly over the predetermined opening on the intact layers. With a pressure on the push-piece, mostly an essentially tension force onto the foil takes place which must be relatively high before the two residual layers tear, so that again the push-piece 5 jerk-like immerses into the container with the already described unpleasant consequences. Attempts have also been made to arrange a centric cutting edge on the lower side of the push-piece which over the whole length has a certain taper angle. The height difference which with this is available is however so slight that because of the elasticity of the still intact polyethylene layer this deforms so far that again there is effected a complete linear resting.

According to this invention, the cutting edge 26 only in the front third of the push-piece 5 runs inclined relatively steeply up towards to cover surface 23, while the lower part, extending towards the film hinge 10, of the cutting edge, runs roughly parallel to the cover surface 23 of the press piece or even runs retrograde again in the direction towards the base surface of the lower part 2. Thus the cutting edge 26 may exert as optimal as possible shearing effect on the layers lying thereunder. The reduction of the inclination of the cutting edge 26 on the push-piece to the front third of the push-piece is based on the recognition that with the now applied pivoting movement the required cutting angle alone already by way of the relative position of the push-piece to the horizontal cutting surface leads to an optimal shearing angle. The negative inclination angle, of the cutting edge 26, which is present in the rear region of the push-piece near to the pivoting axis and is formed by the film hinge 26 by the large angle change of the push-piece itself again leads to an optimal cutting angle.

The position of the push-piece 5 of FIG. 3 corresponds at least approximately to the dead center position of the snap hinge 6. This angle may be optimally designed by way of a suitable formation of the bending spring element 11 and of the relative arrangement of the film hinge 10 as well as of the linkage locations of the bending spring element 11. Already with an immersing angle of about 35° the dead center position of the snap hinge may be achieved so that the push-piece 5 automatically moves further away from here under the effect of force of the bending spring element 11. With this it brushes over the lowest position, as is shown in FIG. 4, in order to remain in an end position rotated maximally by 180°. The push-piece 5 with its pivoting movement pushes the tab L, which previously had covered the predetermined opening, in front of it and finally presses the tab in the end position according to FIG. 5, at least approximately from below onto the cover surface of the container B. In this position the tab L remains held so that neither it nor the push-piece 5 itself may pivot back into the region of the pouring-out opening 3 and by way of this disturbs the pouring-out stream.

Finally then the cover 4 may again be closed using the sealing ring wall 14 on the lower cover surface of the cover 4. Until now it was usual for the sealing ring wall 14 to sealingly bear on the inner edge of the pouring-out opening 3. Accordingly, remains of fluid remained on the sealing wall 7 of the lower part remained covered by the cover but not circumferentially protected. Accordingly these pouring-out remains led to contamination, crystallization or oxidation and influenced the quality of the material to be subsequently poured out and led to aesthetically completely unsatisfactory results. Accordingly it is desirable to dimension the sealing ring wall 14 on the cover 4 such that it may encompass the sealing wall 7 on the lower part from the outside. Thus the whole region which contacts the fluid lies within the closed space in which at least approximately there prevails saturated vapor pressure, by which means it is prevented that the residual quantities crystallize out and further these residual quantities may thus flow back into the container B. Also an increased seal may be achieved. With this formation, specifically, the sealing ring wall 14 without problem may be provided with one or more annular sealing bulges 17 and accordingly the sealing wall 7 on the lower part 2 on the outside may be circumferentially provided with sealing notches 18. This also leads to an improved holding force of the cover 4 on the lower part 2. In order to optimally design this solution as mentioned in the rear region on the adhesive strip 20 there is attached an additional rearward wall 21 on whose upper edge there is located the joint 16 about which pivots the cover 4. Thus the sealing annular wall 14 may be completely circumferential just as the sealing wall 7 on the lower part by which means the closure device 1 optimally and securely closes the pouring-out opening 3.

What is claimed is:

1. In a plastic closure device (1) for a container (B) for fluids, manufactured of laminated paper, wherein the closure device (1) is arranged on the container over a predetermined opening in the laminated paper and has a lower part (2) with a pouring-out opening (3) and a pivotally mounted cover (4) as well as a pivotal push-piece (5) in the lower part (2) for exposing the predetermined opening, the improvement comprising:

at least one snap hinge (6) pivotally connecting the push-piece (5) to the lower part (2) so that the push-piece (5) is pressable into the container (2) about an additional angle and retains the push-piece (5) in a pivoted position; and the at least one snap hinge (6) having at least one bending spring element (11) extending upwards above a cover surface (23) of the push-piece (5) when in an initial position before actuation of the push-piece (5).

2. In the closure device according to claim 1, wherein the at least one snap hinge (6) has a film hinge (10) about which the push-piece (5) pivots and the at least one bending spring element (11) extending over a pivoting axis of the film hinge (10).

3. In the closure device according to claim 2, wherein the push-piece (5) is arranged within a sealing wall (7) edging the pouring-out opening (3) in the lower part (2), and the push-piece (5) is subdivided by the film hinge (10) into a fastening part (8) rigidly attached to a sealing wall and into a pivoting part (9).

4. In the closure device according to claim 3, wherein the fastening part (8) and the pivoting part (9) with respect to a lower edge of the sealing wall (7) is displaced upwards, so that the push-piece (5) is held, by a height of a cutter (24, 25, 26) attached on a lower side, over a surface of the laminated paper of the container (B).

5. In the closure device according to claim 4, wherein the pivoting part (9) with a region distanced from the film hinge (10) via at least one predetermined breakage location (19) is connected to the sealing wall.

6. In the closure device according to claim 3, wherein the at least one bending spring element (11) of the snap hinge (6) via a film hinge is one of directly attached to the sealing wall and indirectly attached to the sealing wall by a console.

7. In the sealing device according to claim 3, wherein the cover (4) comprises a sealing ring wall (14) which sealingly engages within the sealing wall (7) in the lower part (2).

8. In the closure device according to claim 3, wherein the cover (4) comprises a sealing ring wall (14) which sealingly encompasses the sealing wall (7) in the lower part (2).

* * * * *